United States Patent [19]

Lierman

[11] Patent Number: 4,927,158

[45] Date of Patent: May 22, 1990

[54] GAME

[76] Inventor: W. O. Lierman, 2510 Fremont St., Boulder, Colo. 80302

[21] Appl. No.: 812,837

[22] Filed: Dec. 23, 1985

[51] Int. Cl.[5] ..... A63F 3/08

[52] U.S. Cl. ..... 273/268; 273/146; 434/200

[58] Field of Search ..... 273/146, 147, 268, 269; 434/200, 205

[56] References Cited

U.S. PATENT DOCUMENTS

| | | | |
|---|---|---|---|
| 503,403 | 8/1893 | Brinkman | 273/145 D |
| 1,238,522 | 8/1917 | Kalista | 273/269 |
| 1,605,697 | 11/1926 | Birdsall | 434/200 |
| 1,787,521 | 1/1931 | Harrington | 273/146 X |
| 2,304,893 | 12/1942 | Dickson | 434/200 |
| 2,311,453 | 2/1943 | McKeown | 273/147 |
| 4,114,290 | 9/1978 | Cooper | 273/146 |
| 4,359,227 | 11/1982 | Porciello | 273/268 |

FOREIGN PATENT DOCUMENTS

| | | | |
|---|---|---|---|
| 2462918 | 3/1981 | France | 273/268 |
| 2557804 | 7/1985 | France | 273/268 |

*Primary Examiner*—Edward M. Coven
*Assistant Examiner*—R. W. Chiu
*Attorney, Agent, or Firm*—H. Kenneth Johnston, II

[57] ABSTRACT

A game for children and adults alike providing a cheerful and entertaining atmosphere. The game includes a plurality of peg boards with associated pegs for scoring by a plurality of players of the resulting number obtained by rolling a single die. The peg boards contain a total of 21 peg receptacles segregated to resemble the numbers one through six with the matching numbers on the die.

1 Claim, 1 Drawing Sheet

GAME

BACKGROUND OF THE INVENTION

This invention relates to a game device which provides endless entertainment for young and old and yet aids the very young in their counting skills. Generally, children do not enjoy the rigors of learning the basic math skills, yet learn quickly and enjoy doing so when associated with a game. There are numerous games divised for aiding the more advanced math skills as shown by Cooper, U.S. Pat. No. 4,114,290. However, Cooper cannot be readily employed by the very young as they have no understanding of the addition, subtraction or multiplication skills. There are games such as Harrington U.S. Pat. No. 1,787,521 which aid in learning some of the color combinations but does nothing for the math skills. Kalista, U.S. Pat. No. 1,238,522 is a dice game in which the players merely cover spaces with dice matching the numbers on the dice faces. Brinkman, U.S. Pat. No. 503,403 is a game in which the player merely fills his row of pegs, unlike the present invention in which the player must obtain any combination of 7. Except Cooper, which is beyond the ability of young children, the other cited patents do not enhance the math skills or provide the varied entertainment of the present invention.

SUMMARY OF THE INVENTION

The game device of this invention employs a simple hexagonal die numerically imprinted from 1 through 6. The game board consists of a multiple of boards, each having peg receptacles resembling the configuration of a die for the numbers 1 through 6 with corresponding pegs. A player rolls the die and a peg is placed in a peg receptacle corresponding to the number rolled. For illustrative purposes only, if a 5 is rolled, a peg is placed into one of the five peg receptacles in the portion of the board resembling the number 5. A winner is determine when all of the peg receptacles of two numbers adding to seven are obtained, thus the name "Lucky Seven." The pegs are counted that are in all of the peg receptacles except in the six block. The person obtaining the combination of seven first, gets to add an additional seven to his score, plus all the additional pegs scored except that no one is allowed to count the pegs in the six block. If a 6 is rolled, the player receives another turn. One additional turn is received for each 6 rolled. For illustrative purposes only, if both the number 5 and number 2 would be filled, that person would be declared the winner and would add the "Lucky Seven" and all the remaining pegs except any in the six score section.

After four rounds, a round being where a winner has been declared, the highest total score determines the overall winner. As a means of variations for the young, in aiding their learning the entire number of pegs may be counted and the pegs in the number 6 score section is then subtracted from the total points for the score for that round.

DETAILED DESCRIPTION OF THE PREFERRED EMBODIMENTS

Figure 1:
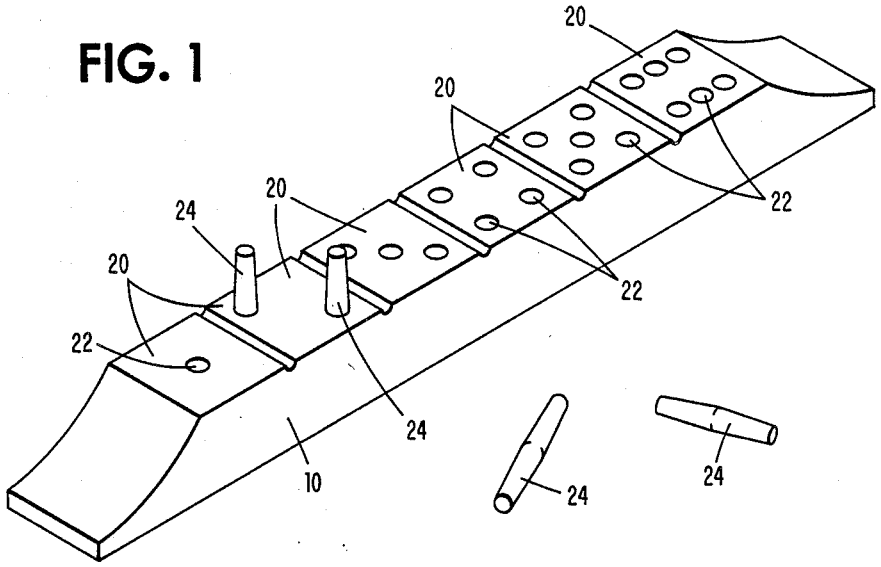
FIG. 1 is a perspective view of the gameboard of this invention.
Figure 2:
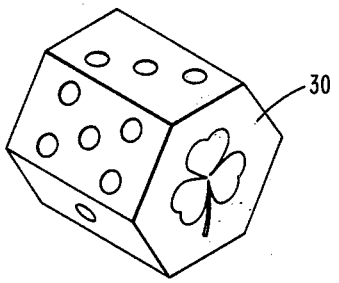
FIG. 2 is a perspective view of the number bearing die.

Referring to the perspective view of the device in FIG. 1, a rectangular game board 10 which aids the young in their math skills and is supplied for each player. The game board includes a multiplicity of peg receptacles 22 representing the numbers one through six of the score section 20.

In the preferred embodiment multi faced die 30 having the numbers one through six is rolled. The number reached by the multi faced die 30 coming to rest in the number which the peg 24 is placed in a peg receptacles 22 in the scoring section 20. When a specific scoring section 20 has all its peg receptacles 22 filled by pegs 24 the player loses his turn when that specific number is rolled on the multi faced die 30, except that when the player rolls a six on the multi faced die 30, the player receives an additional turn even if the six scoring section 20 has been filled. The players continue take turns rolling the multi faced die 30 until one of the players has filled two of the scoring section 20 that add up to 7. The player having the sum of 7 in two of the score section 20 adds 7 to his score plus all of the pegs 24 in the peg receptacle 22 except that no peg 24 is counted if it is in the peg receptacle 22 in the six section of the score section 20.

For illustrative purposes only, if a player after numerous rolls of the multi faced die 30, has filled all of the peg receptacle 22 in the number 5 and 2 of the score section 20, the player would score 7 for being first to have the score of seven by filling the peg receptacle 22 in two of the score sections adding up to seven. The player receiving an additional one point for each peg 24 in the peg receptacle 22 in the numbers 1 through 5 of the score section 20. No points are received for pegs 24 in the peg receptical 22 of the number 6 of the score section 20. Another player scoring 7 by filling the peg receptacle 22 in the number 6 and 1 of the score section 20 would count seven for being first to get the number 7 plus an additional 1 point for each peg 24 in peg receptacle 22 in the number 1 through 5 of the score section 20. The player does not count the pegs 24 in the peg receptacle 22 of the number 6 of the score section 20.

When a player obtains the number 7 in two of the numbers of the score section 20 that player adds an additional 7 to his count of the peg 24 in the peg receptacle 22 except those pegs 24 in the peg receptacle 22 of the number 6 of the score section 20.

While the foregoing specification embodiment of the invention have been set forth in considerable detail for the purposes of making a complete disclosure of the invention it will be apparent to those skilled in the art that numerous changes may be made in such detail without departing from the spirit and principles of the invention.

What is claimed is:

1. An improved game device for aiding the learning of basic skills and providing extensive entertainment comprising:

a plurality of game boards each having a scoring section;

each said score section having 21 peg receptacles for scoring;

said peg receptacles are segregated in the form of numeric indicia of a die from 1 through 6;

a die, said die with faces having numeric indicia on said faces;

a plurality of associated pegs, said pegs being constructed for placement in said peg receptacles for scoring.

* * * * *